US008127588B1

(12) United States Patent
Halpin et al.

(10) Patent No.: US 8,127,588 B1
(45) Date of Patent: Mar. 6, 2012

(54) APPARATUS AND METHODS FOR FORMING A FINGER-ENGAGING PORTION IN A STAY-ON-TAB OF A LID OF A CONTAINER

(76) Inventors: Harold W. Halpin, Glendale, AZ (US); Katherine E. Higgins, Glendale, AZ (US)

( * ) Notice: Subject to any disclaimer, the term of this patent is extended or adjusted under 35 U.S.C. 154(b) by 0 days.

(21) Appl. No.: 13/070,431

(22) Filed: Mar. 23, 2011

(51) Int. Cl.
*B25B 7/12* (2006.01)

(52) U.S. Cl. ..... 72/409.11; 72/384; 72/409.01; 72/458; 413/8; 413/14

(58) Field of Classification Search ..... 72/381, 72/382, 383, 384, 407, 409.01, 409.11, 433, 72/434, 450, 457, 458; 413/8, 14
See application file for complete search history.

(56) References Cited

U.S. PATENT DOCUMENTS

| | | | | |
|---|---|---|---|---|
| 2,213,971 | A * | 9/1940 | Vaughn | 413/38 |
| 2,840,134 | A * | 6/1958 | Rayburn et al. | 72/313 |
| 3,121,447 | A * | 2/1964 | Zoschg | 140/71.5 |
| 4,944,177 | A * | 7/1990 | Womack | 72/409.01 |
| 5,820,326 | A * | 10/1998 | Melson | 413/8 |
| 6,619,100 | B2 * | 9/2003 | Berg et al. | 72/402 |

* cited by examiner

*Primary Examiner* — Edward Tolan
(74) *Attorney, Agent, or Firm* — Parsons & Goltry; Michael W. Goltry; Robert A. Parsons

(57) ABSTRACT

An apparatus for forming a finger-engaging portion in a stay-on-tab of a lid of a container includes a support, a fixture mounted to the support for movement between a first position and a second position in opposition to stay-on-tab of the lid of the container, and an abutment mounted to the fixture for movement between an open position and a closed position in opposition to the fixture and the stay-on tab in the second position of the fixture to bend the stay-on-tab between the fixture and the abutment to form in the stay-on-tab a finger-engaging portion that is upturned relative to the lid of the container.

7 Claims, 9 Drawing Sheets

APPARATUS AND METHODS FOR FORMING A FINGER-ENGAGING PORTION IN A STAY-ON-TAB OF A LID OF A CONTAINER

FIELD OF THE INVENTION

The present invention relates generally to containers having lids formed with stay-on-tabs attached as levers to depress scored parts of the lids and, more particularly, to apparatus and methods for forming finger-engaging portions in stay-on-tabs.

BACKGROUND OF THE INVENTION

Early metal beverage cans were opened by a can-piercer or church key, which is a device resembling a bottle opener with a sharp point. The can was opened by punching two triangular holes in the lid, including a large hole for drinking and a smaller hole to admit air. Beginning in the early 1920's, inventors began applying for patents on cans with tab tops, but the technology of these inventions was largely impractical. The development of the pull-tab came during the late 1950's and early 1960's. While the pull-tab marked an important step in can-opening technology, they detach completely from, contributed to roadside litter, and would often drop into the can so as to be prone to inadvertent ingesting. The stay-on-tab followed in the mid 1970's and remains in use today.

The stay-on-tab uses a separate tab attached to the upper surface of the lid of a can as a lever to depress a scored part of the lid, which folds underneath the lid and out of the way of the resulting opening. The stay-on-tab remains in use today, and is incorporated into most beverage cans. To use a stay-on-tab to open a beverage can the stay-on-tab must be pried upwardly and away from the upper surface of the lid to allow the stay-on-tab to depress the scored part of the lid. Most users pry open the stay-on-tab with a finger, which can be painful and difficult, especially for people with weak or small hands, such as children and the elderly, thus necessity further improvement in the art.

SUMMARY OF THE INVENTION

According to the principle of the invention, disclosed is an apparatus for forming a finger-engaging portion in a stay-on-tab attached as a lever to an upper surface of a lid of a container to depress a scored part of the lid. The stay-on-tab has an inner extremity, an opposed outer extremity, an intermediate portion between the inner and outer extremities. The apparatus for forming a finger-engaging portion in the stay-on-tab includes a support, a fixture mounted to the support for movement between a first position and a second position in opposition to the lid of the container, the fixture for bracing the stay-on-tab at the intermediate portion in the second position of the fixture, and an abutment mounted to the fixture for movement between an open position and a closed position in opposition to the fixture and the outer extremity of the stay-on tab in the second position of the fixture to bend the stay-on-tab between the fixture and the abutment at the intermediate portion of the stay-on-tab to form in the outer extremity of the stay-on-tab a finger-engaging portion that is upturned relative to the inner extremity of the stay-on-tab and upper surface of the lid. A first lever is pivotally coupled between the support and the fixture for moving the fixture between the first and second positions thereof. A second lever is pivotally coupled between the fixture and the abutment for moving the abutment between the open and closed positions. A first bias is applied to the first lever biasing the first lever toward the first position of the fixture. The first bias is applied by at least one first spring coupled between the first lever and the support biasing the first lever in the first position of the fixture. A second bias is applied to the second lever biasing the second lever toward the open position of the abutment. The second bias is applied by at least one second spring coupled between the second lever and the fixture biasing the second lever in the open position of the abutment. The at least one first spring is a first compression spring. The at least one second spring is a second compression spring.

According to the principle of the invention, disclosed is an apparatus for forming a finger-engaging portion in a stay-on-tab attached as a lever to an upper surface of a lid of a container to depress a scored part of the lid. The stay-on-tab has an inner extremity, an opposed outer extremity, an intermediate portion between the inner and outer extremities. In this embodiment, the apparatus includes a support, and a fixture mounted to the support for movement between a first position and a second position in opposition to the lid of the container, the fixture for bracing the stay-on-tab at the intermediate portion in the second position of the fixture. A first lever has a first inner end and an opposed first handled outer end. The first lever is mounted to the support at the first inner end for pivotal movement between a raised position of the first handled outer end away from the support and a lowered position of the first handled outer end toward the support. The fixture is coupled to the first handled lever between the inner end and the opposed handled outer end. The fixture is movable between the first and second positions in response pivotal movement of the first lever between the raised and lowered positions of the first handled end. An abutment is carried by a second lever having a second inner end and an opposed second handled outer end, the second lever mounted to the fixture at the second inner end for pivotal movement between a raised position of the second handled outer end toward the support and a lowered position of the second handled outer end away from the support. The abutment is movable between an open position and a closed position in opposition to the fixture and the outer extremity of the stay-on tab in the second position of the fixture in response pivotal movement of the second lever between the raised and lowered positions of the second handled end to bend the stay-on-tab between the fixture and the abutment at the intermediate portion of the stay-on-tab to form in the outer extremity of the stay-on-tab a finger-engaging portion that is upturned relative to the inner extremity of the stay-on-tab and upper surface of the lid. A first bias is applied to the first lever, which biases the first lever toward the raised position of the first handled outer end. The first bias is applied by at least one first spring coupled between the first lever and the support biasing the first lever in the raised position of the first handled outer end. A second bias is applied to the second lever, which biases the second lever toward the raised position of the second handled outer end. The second bias is applied by at least one second spring coupled between the second lever and the fixture biasing the second lever in the raised position of the second handled outer end. The at least one first spring is a first compression spring. The at least one second spring is a second compression spring.

According to the principle of the invention, a method is disclosed for forming a finger-engaging portion in a stay-on-tab attached as a lever to an upper surface of a lid of a container to depress a scored part of the lid, wherein the stay-on-tab has an inner extremity, an opposed outer extremity, an intermediate portion between the inner and outer extremities. The method includes providing a fixture mounted for movement between a first position and a second position, providing an abutment mounted to the fixture for movement between an open position and a closed position in opposition to fixture, locating the container relative to the fixture to register stay-on-tab with the fixture, moving the fixture from the first position to the second position to brace the stay-on-tab at the intermediate portion thereof locating the abutment in opposition to the outer extremity of the stay-on-tab, and moving the abutment from the open position to the closed position to engage the outer extremity of the stay-on-tab to bend the stay-on-tab between the fixture and the bender at the intermediate portion of the stay-on-tab to form in the outer extremity of the stay-on-tab a finger-engaging portion that is upturned relative to the inner extremity of the stay-on-tab and upper surface of the lid. The step of moving the fixture from the first position to the second position further includes mounting a first lever between the support and the fixture for pivotal movement between third and fourth positions, and pivoting the first lever from the third position to the fourth position to move the fixture from the first position to the second position. The step of moving the abutment from the open position to the closed position further includes mounting a second lever between the fixture and the abutment for pivotal movement between third and fourth positions, and pivoting the second lever from the fourth position to the fifth position to move the abutment from the open position to the closed position.

BRIEF DESCRIPTION OF THE DRAWINGS

Referring to the drawings.

DETAILED DESCRIPTION

Figure 1:
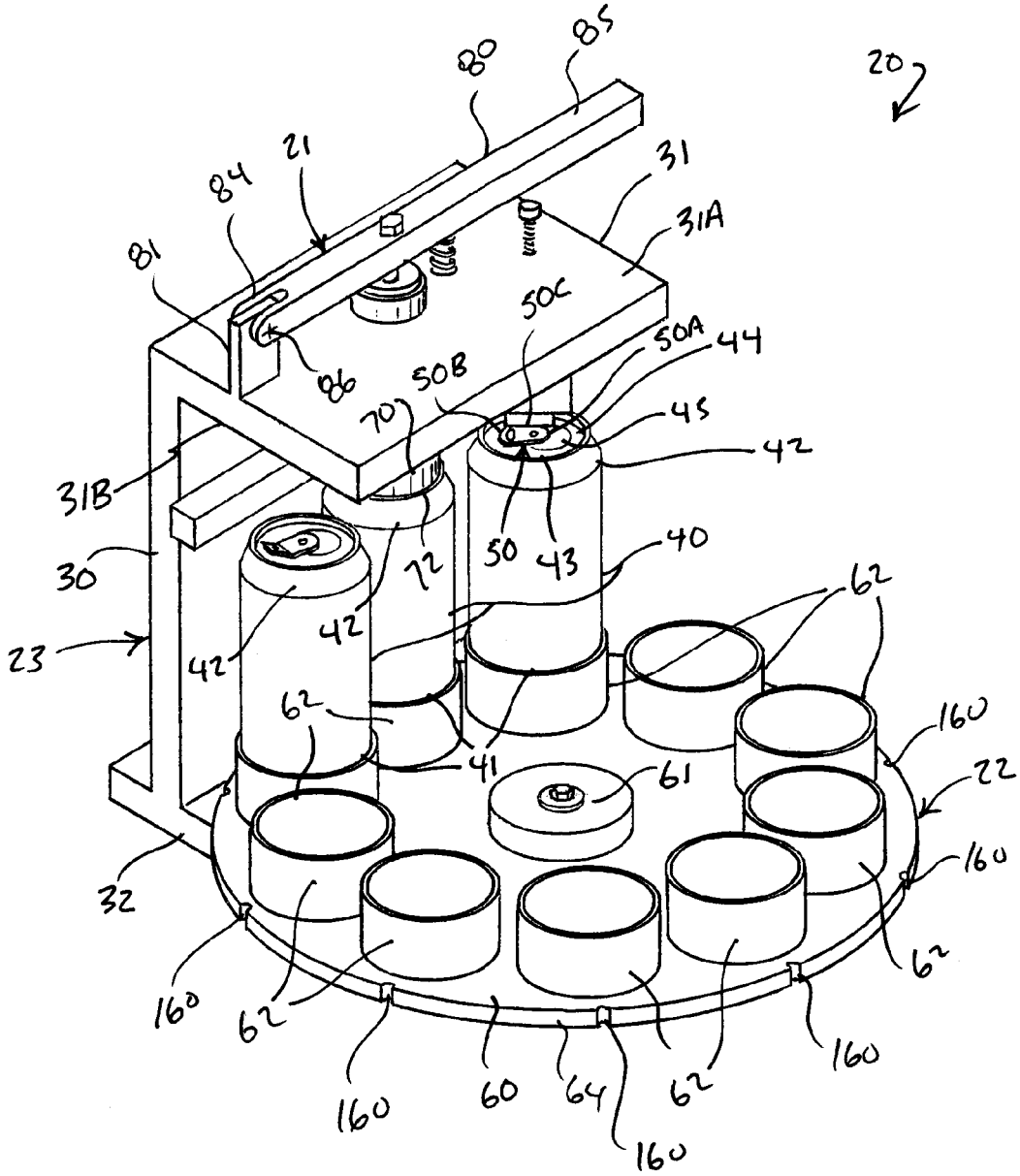
FIG. 1 is a perspective view of an apparatus for forming finger-engaging portions in container stay-on-tabs, the apparatus constructed and arranged in accordance with the principle of the invention.

Turning now to the drawings, in which like reference characters indicate corresponding elements throughout the several views, attention is first directed to FIG. 1 illustrating an apparatus 20 for forming finger-engaging portions in container stay-on-tabs, in accordance with the principle of the invention. Apparatus 20 generally consists of a conveyance 21 and a bending assembly 22 supported by a supporting chassis 23. Chassis 23 consists of an upstanding support member 30 coupled between opposed, parallel top and bottom supports 31 and 32. Conveyance 21 is carried by bottom support 32, and bending assembly 21 is carried by top support 31.

Conveyance 22 receives and holds containers 40, and is operable for conveying containers 40 relative to bending assembly 21 between top and bottom supports 31 and 32 of chassis 23. Containers 40 are standard beverage cans designed to hold a single serving of a beverage, such as a soft drink or other beverage. Containers are fashioned of tin or aluminum and each have a bottom 41 and an opposed top 42 formed with a lid 43 having an upper surface 44 and a scored part 45. Lid 43 is formed with a stay-on-tab 50 having an inner extremity 50A, an opposed outer extremity 50B, and an intermediate portion 50C between inner and outer extremities 50A and 50B. Stay-on-tab 50 is attached as a lever to upper surface 44 of lid 43 to pivot and depress with inner extremity 50A scored part 45 of lid 43, which folds underneath lid 43 and out of the way of the resulting opening formed in lid 43.

Figure 2:
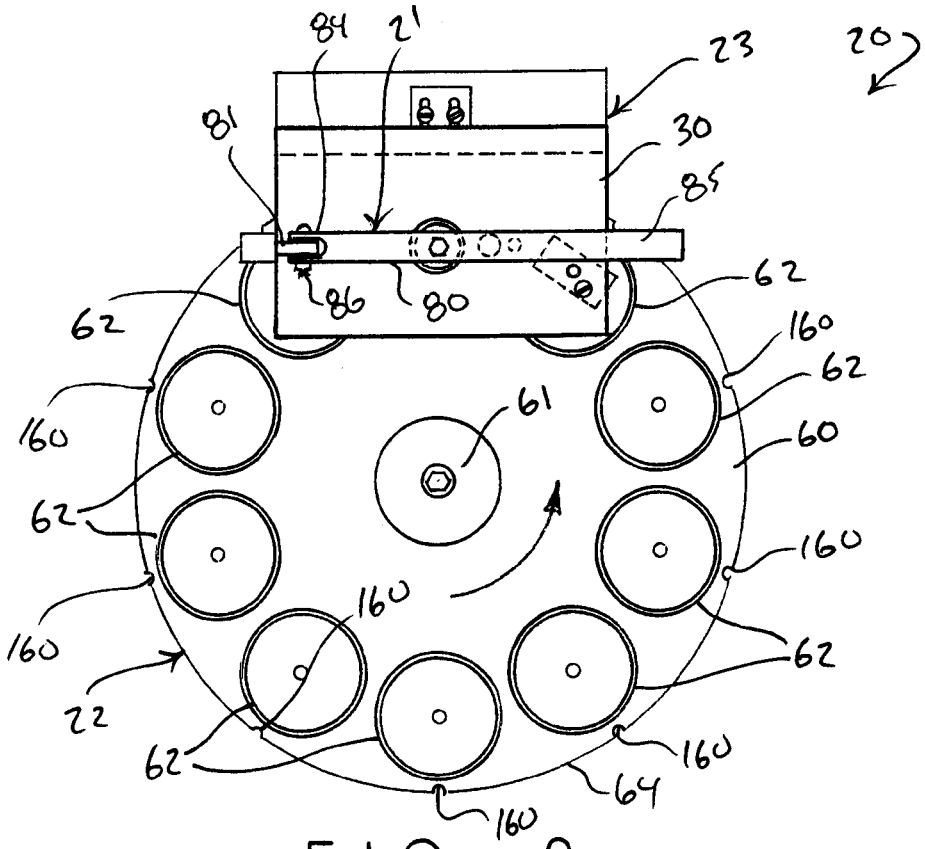
FIG. 2 is a top plan view of the apparatus of FIG. 1.
Figure 3:
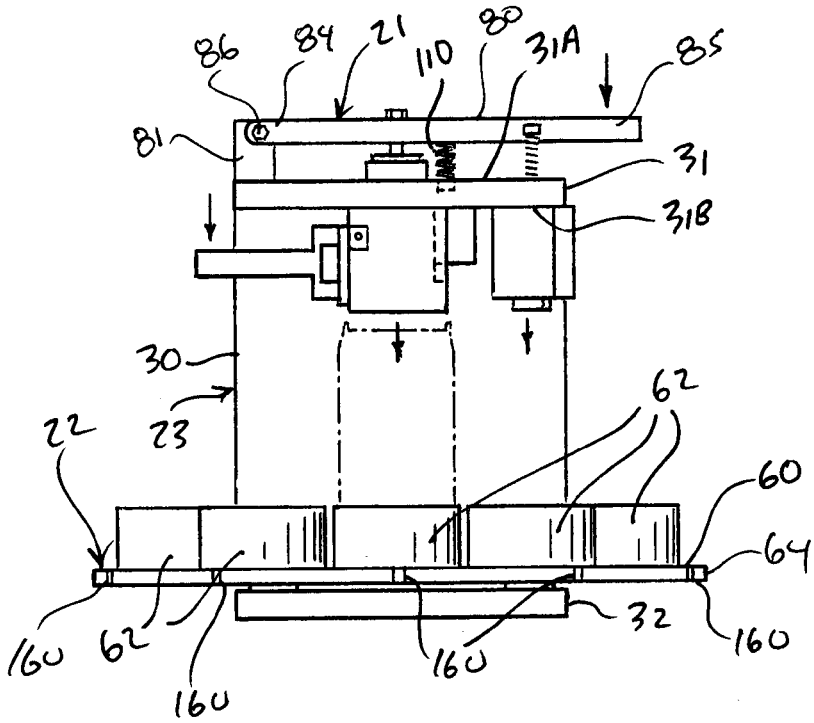
FIG. 3 is a front elevation view of the apparatus of FIG. 1.
Figure 4:
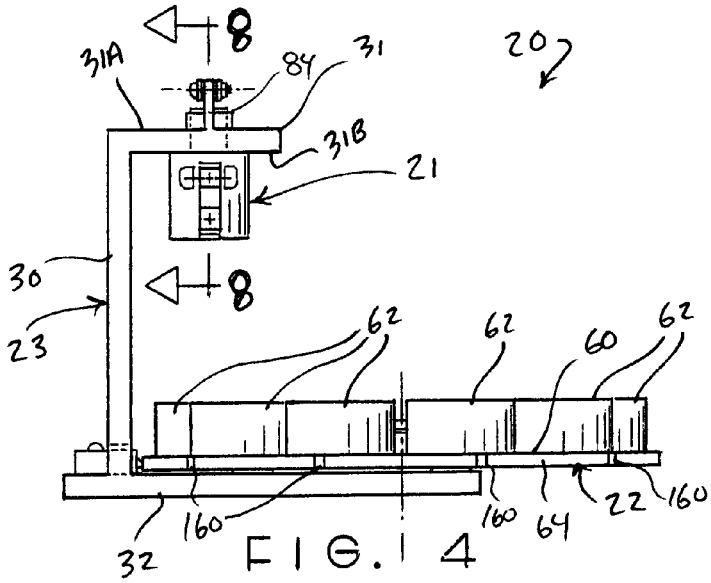
FIG. 4 is a right side elevation view of the apparatus of FIG. 1.

Conveyance 22 is set atop bottom support 32 between bottom support 32 and top support 31 as shown in FIG. 1, FIG. 3, and FIG. 4. Conveyance 22 is a simple turntable 60 mounted for rotation to bottom support 32 with a central rotating hub 61 illustrated in FIG. 1, FIG. 2, and FIG. 5. Turntable 60 is broad and flat and disk-shaped, and is formed with attached receptacles 62 that encircle rotating hub 61 between rotating hub 61 and parametric edge 64 of turntable 60. Receptacles 62 are receiving areas for containers 40, and are sized to accept bottoms 41 of containers 40 as shown in FIG. 1 to hold containers 40 upright in preparation for conveying to and from bending assembly 21 of apparatus 20. In the present embodiment, as a matter of example, turntable 60 is formed with ten, equally spaced-apart receptacles 62 to receive and convey ten corresponding containers relative to the bending assembly 21, and turntable 60 may incorporate less or more receptacles 62 as desired.

Figure 8:
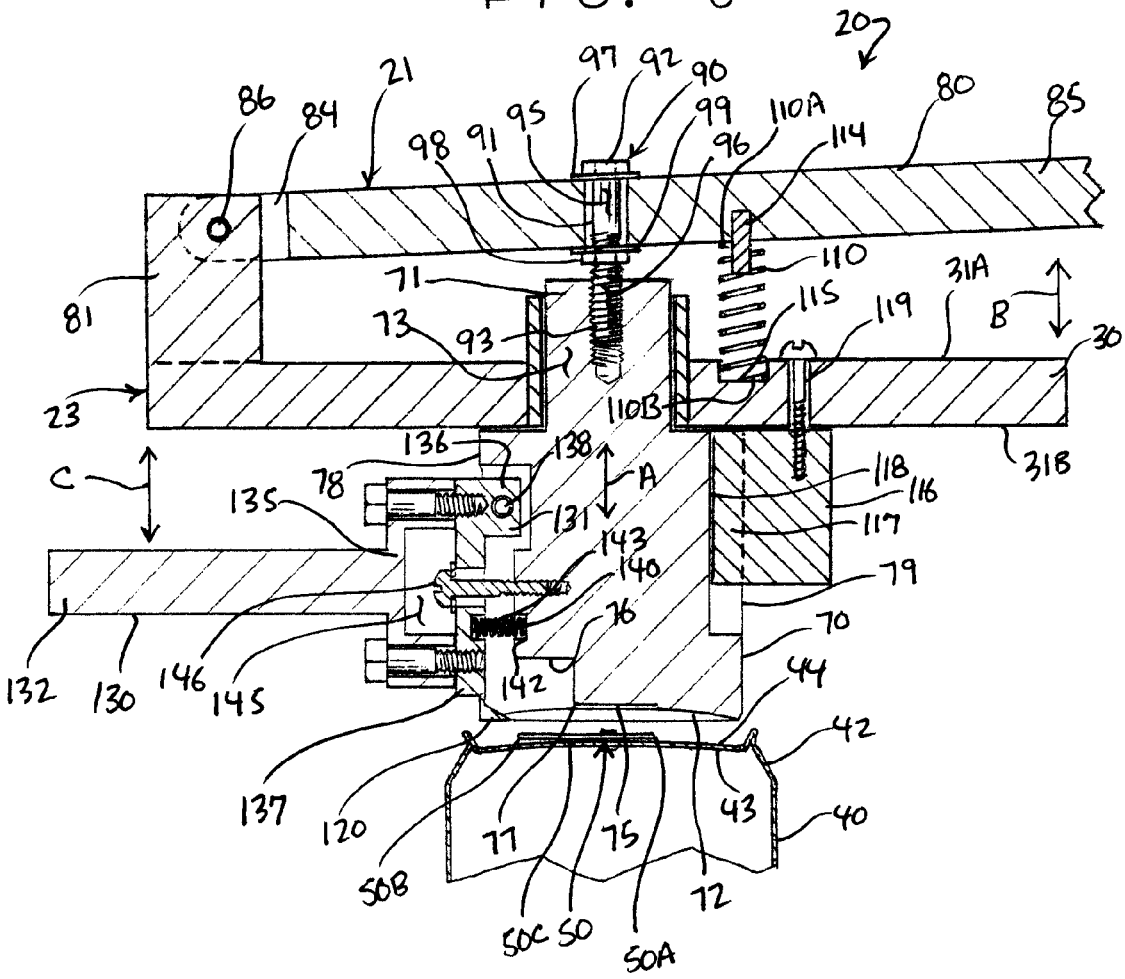
FIG. 8 is a section view of a bending assembly taken along line 8-8 of FIG. 4.
Figure 9:
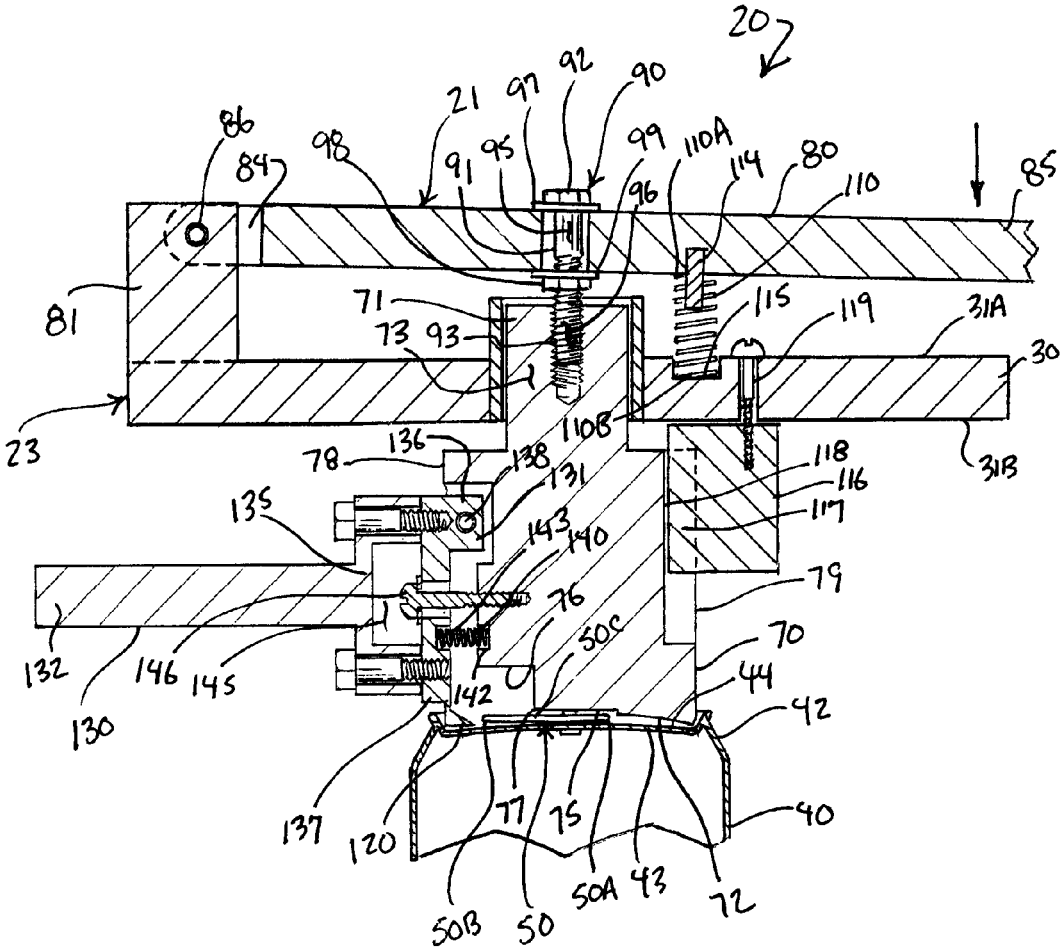
FIGS. 9-12 are views similar to that of FIG. 8 illustrating a sequence of operation of the bending assembly to form a finger-engaging portion in a container stay-on-tab.

In reference to a container 40 previously discussed in conjunction with FIG. 1, bending assembly 21 of apparatus 20 is used to form a finger-engaging portion in stay-on-tab 40 attached as a lever to upper surface 44 of lid 43 of container 40 to depress scored part 45 of lid 43. Referencing FIG. 1, FIG. 3, FIG. 4, and FIG. 8, top support 30 has an upper surface 31A and an opposed lower surface 31B that faces downwardly toward conveyance 22 and bottom support 32 as shown in FIG. 1, FIG. 3, and FIG. 4. Bending assembly 21 includes a fixture 70 mounted to top support 31 for movement in reciprocal directions as indicated by the double arrowed line A between a first or raised position as shown in FIG. 8 toward lower surface 31B of top support 31 and a second or lowered position away from lower surface 31B of top support 31 as shown in FIG. 9 in opposition to lid 43 of container 40 set under fixture 70.

Fixture 70 has an upper end 71 and an opposed lower end 72. Upper end 71 of fixture 70 is received by and through a collared opening 73 formed through top support 31, which extends through top support 31 from upper surface 31A to lower surface 31B. Fixture 70 extends downwardly from upper end 71 applied to collared opening 73, and further extends downwardly from lower surface 31B of top support 31 to lower end 72, which is formed with a working face 75 and an inwardly-directed notch 76 that intersect at corner or edge 77. For reference purposes, under lower surface 31B of top support member 30 fixture 70 defines opposed front and rear ends 78 and 79.

Movement of fixture 70 is managed by a lever 80. Lever 80 is pivotally coupled between top support 30 and fixture 70 and is operative through pivoting for moving fixture 70 between its raised and lowered positions. Top support 30 is formed with an attached upstanding member 81, which projects upwardly from upper surface 31A. Member 81 is part of top support 30. Lever 80 opposes and is spaced from upper surface 31A of top support 31 and extends over and across upper end 71 of fixture 70. Lever 80 has an inner end 84 and an opposed handled outer end 85. Inner end 84 of lever 80 is bifurcated. Member 81 is located in the bifurcation formed in inner end 84, and bifurcated inner end 84 of lever 80 is pivotally coupled to member 81 with a pivot pin 86, which defines a pivot point of inner end 84 of lever 80. Lever 80 pivots about the pivot point at pivot pin 86 applied between inner end 84 of lever 80 and member 81 in reciprocal directions as indicated by the double arrowed line B in FIG. 8 between a raised position of handled outer end 85 away from upper surface 31A of support 31 as shown in FIG. 8 and a lowered position of handled outer end 85 toward upper surface 31A of support 30 as shown in FIG. 9. Handled outer end 85 of lever 80 is available to be taken up by hand to allow a user to pivot lever 80 by hand at handled outer end 85. As lever 80 is formed with handled outer end 85, lever 80 is a handled lever.

Upper end 71 of fixture 70 is coupled to lever 80 at an intermediate location between inner end 84 and opposed handled outer end 85 of lever 80. Upper end 71 of fixture 70 is coupled to lever 80 with a fastener 90. Fastener 90 is a threaded fastener consisting of an elongate shank 91 having an inner end formed with a head 92 and an opposed threaded outer end 93. Fastener 90 is applied to an opening 95 formed in lever 80 at an intermediate position relative to inner end 84 and opposed handled outer end 85. Shank 91 extends through opening 95 from head 92 located on the outer side of lever 80 opposing opening 95 and downwardly through opening 95 to threaded outer end 93, which is threaded within a threaded opening 96 formed in upper end 71 of fixture 70. A washer 97 encircles shank 91 and is positioned between head 92 and the outer side of lever 80 opposing opening 95 to ensure head 92 does not fall into opening 95. A nut 98 is threaded onto threaded outer end 93 along the underside of lever 80 between lever 80 and upper end 71 of fixture, and a washer 99 encircles shank 91 between nut 98 and the underside of lever 80 opposing opening 95 to ensure nut 98 does not fall into opening 95. Fastener 90 is retained to lever 80 between head 92 and washer 97 formed on the outer side of lever 80, and nut 98 and washer 99 formed on the inner side of lever 90. Opening 95 has an inner diameter that is substantially larger than the outer diameter of shank 91 passing through opening 95, and this allows fastener 90 to displace in opening 95 in response to pivotal movement of lever 80 between the raised position of handled outer end 85 as shown in FIG. 8 and the lowered position of handled outer end 85 as shown in FIG. 9. The raised position of handled outer end 85 of lever 80 corresponds to the raised position of fixture 70 as shown in FIG. 8, and the lowered position of handled outer end 85 of lever 80 corresponds to the lowered position of fixture 70 as shown in FIG. 9. Fixture 70 encounters lower surface 31B of top support 30 in the raised position of fixture 70 as shown in FIG. 8, which limits the upward movement of fixture 70 and handled outer end 85 of lever 80, which defines their respective raised positions.

A bias is applied to lever 80, which biases lever 80 toward the raised position of handled outer end 85 of lever 80 and away from the lowered position of handled outer end 85 of lever 80. This described bias is applied by a spring coupled between lever 80 and top support 30, which acts between lever 80 and top support 30 biasing lever 80 toward the raised position of handled outer end 85. In the present embodiment, the spring applying the bias to lever 80 is a compression spring 110. Compression spring 110 is located between handled outer end 85 of lever 80 and the attachment point between upper end 71 of fixture 70 and lever 80, and is applied and captured between the underside of lever 80 and upper surface 31A of top support 30. Compression spring 110 is outwardly biased, and has opposed upper and lower ends 110A and 110B. Upper end 110A of spring 110 encircles a pin 114 applied to the underside of lever 80, and extends downwardly therefrom to lower end 110B, which is received by an opposed recess 115 formed in upper surface 31B of top support 30. Compression spring 110 is captured by and between pin 114 and recess 115. Although pin 114 is carried by lever 80 and recess 115 is formed in upper surface 31A of top support 30, this arrangement can be reversed if so desired. Furthermore, although spring is formed between lever 80 and top support 30 to supply the applied bias, more can be used if so desired.

And so handled outer end 85 of lever 80 is available to be taken up by hand at handled outer end 85 to allow a user to act on and pivot lever 80 by hand between the raised and lowered positions of handled outer end 85 to facilitate the corresponding movement of fixture 70 between its raised and lowered positions. Pivoting lever 80 from the raised position of handled outer end 85 to the lowered position of handled outer end 85 is carried out through the application of force applied to handled outer end 85 that is sufficient to overcome the bias applied to lever 80 by spring 110. Once in the lowered position of handled outer end 85 and fixture 70, the force applied to lever 80 to overcome the bias applied by spring 110 may simply be removed, which will allow spring 110 to act between lever 80 and top support 31 to move and reset handled outer end 85 and fixture 70 back to their respective raised positions in preparation for the next action.

As best seen in FIG. 8, a block 116 is secured to lower surface 31B of top support 30 and extends downwardly therefrom along rear end 79 of fixture 70. Block 116 has an extension or tongue 117 that is received by a corresponding groove 118 formed in rear end 79 of fixture 70. Tongue 117 reciprocates along groove 118 in response to movement of fixture 70 between its raised and lowered positions, and tongue 117 and groove 118 cooperate as a guide assembly to guide and support fixture 70 as it moves between its raised and lowered positions. In the present example, block 116 is secured in place to top support 30 with a threaded fastener 119.

Figure 10:
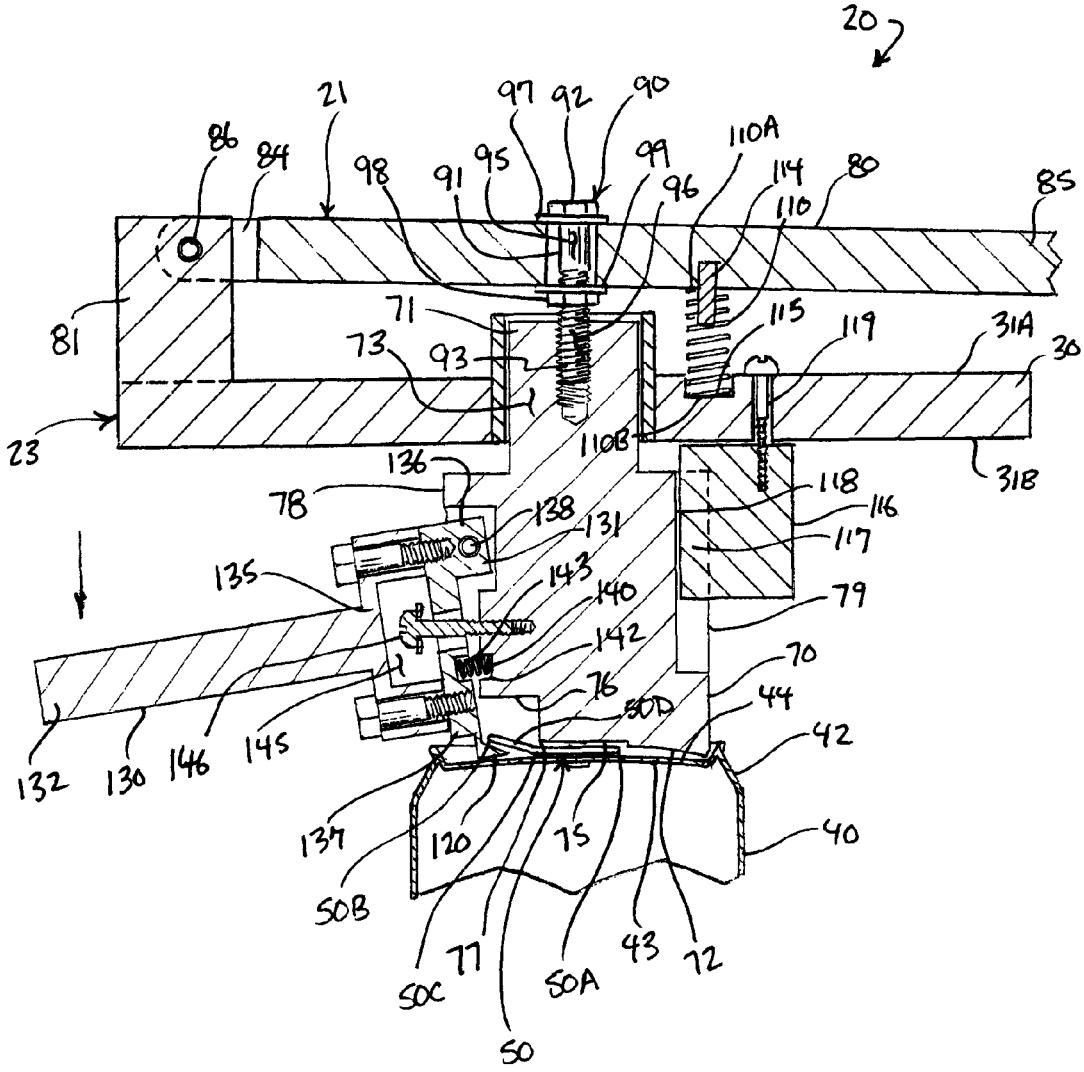

Bending assembly 21 further includes an abutment 120. Abutment 120 is located at lower end 72 of fixture 70 and opposes notch 76. Abutment 120 is mounted to fixture 70 for movement in opposition to lower end 72 of fixture 70 between an open position as shown in FIG. 8 away from lower end 72 of fixture 70 and from notch 76 formed in upper end 71 of fixture 70, and a closed position as shown in FIG. 10 toward fixture 70 and upwardly and inwardly toward notch 76 in lower end 72 of fixture 70. In the lowered position of fixture 70 away from lower surface 31B of top support 31 as shown in FIG. 9 in opposition to lid 43 of container 40 set under fixture 70, abutment 120 located at lower end 72 of fixture 70 is movable between its open position as shown in FIG. 9 and its closed position as shown in FIG. 10 in opposition to fixture 70 and outer extremity 50B of stay-on tab 50 to bend stay-on-tab 50 between fixture 70 and abutment 120 at intermediate portion 50C of stay-on-tab 50 as shown in FIG. 10 to form in the outer extremity 50B of stay-on-tab 50 a finger-engaging portion 50D that is upturned at intermediate portion 50C relative to inner extremity 50A of stay-on-tab 50 and upper surface 44 of lid 43.

Referencing FIG. 8, abutment 120 is carried by a lever 130. Movement of abutment 120 is managed by lever 130. Lever 130 is located under lower surface 31B of top support 30, and is spaced from lower surface 31B of top support 30. Lever 130 is pivotally coupled between fixture 70 and abutment 120 and is operative through pivoting for moving abutment 120 between its open and closed positions. Lever 130 is pivotally coupled to fixture 70 at front end 78 of fixture 70, and lever 130 extends outwardly and away from front end 78 of fixture 70 under lower surface 31B of top support 30.

Lever 130 has an inner end 131 and an opposed handled outer end 132. Inner end 131 of lever 130 is a head 135 having an upper end 136 and an opposed lower end 137 formed with abutment 120. Upper end 136 of head 135 forming inner end 131 of lever 130 is pivotally coupled to front end 78 of fixture 70 with a pivot pin 138, which defines a pivot point of inner end 131 of lever 130. Lever 130 pivots about the pivot point at pivot pin 138 applied between inner end 131 of lever 130 and front end 78 of fixture 70 in reciprocal directions as indicated by the double arrowed line C in FIG. 8 between a raised position of handled outer end 132 toward lower surface 31B of support 31 as shown in FIG. 8 that defines the open position of abutment 120, and a lowered position of handled outer end 132 away from lower surface 31B of support 30 as shown in FIG. 10 that defines the corresponding closed position of abutment 120. Handled outer end 132 of lever 130 is available to be taken up by hand to allow a user to pivot lever 130 through the application of force between the raised and lowered positions of handled end 132 to move abutment 120 between its open position shown in FIG. 8 and its closed position shown in FIG. 10, respectfully. The raised position of handled outer end 132 of lever 130 corresponds to the open position of abutment 120 as shown in FIG. 8, and the lowered position of handled outer end 132 of lever 130 corresponds to the closed position of abutment 120 as shown in FIG. 10. As lever 130 is formed with handled outer end 132, lever 13 is a handled lever.

A bias is applied to lever 130, which biases lever 130 toward the raised position of handled outer end 132 of lever 130 and away from the lowered position of handled outer end 132 of lever 130. This described bias is applied by a spring coupled between lever 130 and front end 78 of fixture 70, which acts between lever 130 and front end 78 of fixture 70 biasing lever 130 toward the raised position of handled outer end 132. In the present embodiment, the spring applying the bias to lever 130 is a compression spring 140. Compression spring 140 is located between upper and lower ends 136 and 137 of head 135 of inner end 131 of lever 130, and is applied and captured between front end 78 of fixture 70 and head 135 of inner end 131 of lever 130. Compression spring 140 is outwardly biased, and has opposed inner and outer ends. The inner end of compression spring 140 is received by a recess 142 formed in front end 78 of fixture 70, and the opposed outer end of compression spring 140 is received by a corresponding recess 143 formed in head 135 of inner end 131 of lever 130. Compression spring 140 is captured by and between recesses 142 and 143. Head 135 is formed with an internal chamber 145, and a coupling 146 in the form of a threaded fastener is coupled between front end 78 of fixture 70 and chamber 145, which interacts with head 135 of front end 131 of lever 130 limiting pivotal movement of lever 130 beyond the raised position of handled outer end 132 of lever 130 corresponding to the open position of abutment 120.

And so handled outer end 132 of lever 130 is available to be taken up by hand to allow a user to pivot lever 130 by hand at handled outer end 132 between the raised and lowered positions of handled outer end 132 to facilitate movement of abutment 120 between its open and closed positions. Pivoting lever 130 from the raised position of handled outer end 132 to the lowered position of handled outer end 132 is carried out through the application of force applied to handled outer end 132 that is sufficient to overcome the bias applied to lever 130 by spring 140. Once in the lowered position of handled outer end 132 and the closed position of abutment 120, the force applied to lever 130 to overcome the bias applied by spring 140 may simply be removed, which will allow spring 140 to act between lever 130 and fixture 70 to move and reset handled outer end 132 and abutment 120 back to their respective raised and open positions in preparation for the next action.

Again in reference to a container 40 previously discussed in conjunction with FIG. 1, apparatus 20 is used to form a finger-engaging portion in stay-on-tab 40 attached as a lever to upper surface 44 of lid 43 of container 40 to depress scored part 45 of lid 43. To employ apparatus 20 in this operation, a container 40 is positioned upright in a receptacle 62 of conveyance 22 under lower end 72 of fixture 70 as shown in FIG. 1. FIGS. 9-12 are views similar to that of FIG. 8 illustrating a sequence of operation of apparatus 20 to form a finger-engaging portion in a container stay-on-tab, and FIGS. 9-12 incorporate the reference numerals incorporated in FIG. 8 for illustration and reference. FIG. 8 is a fragmented section view of container 40 set upright under lower end 72 of fixture 70, with lower end 72 of fixture 70 confronting and facing upper surface 44 of lid 43 in top 42 of container 40. Container 40 is specifically oriented to register stay-on-tab with fixture 70, such that working face 75 of lower end 72 of fixture 70 opposes stay-on-tab 50 and extends from corner or edge 77 of lower end 72 of fixture 70 opposite intermediate portion 50C of stay-on-tab 50 toward rear end 79 of fixture 70 to inner extremity 50A of stay-on-tab 50, and notch 76 opposes stay-on-tab 50 from outer extremity 50B of stay-on-tab 50 directed toward front end 78 of fixture 70 to intermediate portion 50C of stay-on-tab 50. In this starting position, fixture 70 is in its raised position and abutment 120 is in its open position.

From this starting position, fixture 70 is moved from its raised position to its lowered position as shown in FIG. 9 through the pivoting of lever 80 from the raised position of handled outer end 85 to the lowered position of handled outer end 85 applying lower end 72 toward and to outer surface 44 of lid 43 formed in top 42 of container 40 juxtaposing working face 75 opposite to stay-on-tab 50 from corner 77 opposing intermediate portion 50C of stay-on-tab 50 to inner extremity 50A of stay-on-tab 50 directed toward rear end 79 of fixture 70, and juxtaposing notch 76 opposite to outer extremity 50B of stay-on-tab 50 from outer extremity 50B of stay-on-tab 50 directed toward front end 78 of fixture 70 to intermediate portion 50C of stay-on-tab 50 located at corner or edge 77 of lower end 72 of fixture 70. This application of fixture 70 to container 40 as herein specifically described functions to brace stay-on-tab 50 at intermediate portion 50C in preparation for bending stay-on-tab 50 with bending assembly 21 and locates abutment 120 in opposition to outer extremity 50B of the stay-on-tab 50. In this position, abutment 120 is opposes and is registered with outer extremity 50B of stay-on-tab 50 in preparation for the next step in the operation of apparatus 20.

Having moved fixture 70 from its raised position to its lowered position applied toward and to top of container 40 as described and as clearly shown in FIG. 9, through the pivoting of lever 130 from the raised position of handled outer end 132 to the lowered position of handled outer end 132 abutment 120 is moved from its open position in FIG. 9 to its closed position as shown in FIG. 10 inwardly and upwardly toward notch 76 and outer extremity 50B of stay-on-tab 50 to engage outer extremity 50B of stay-on-tab 50 as shown in FIG. 9 to bend stay-on-tab 50 between corner or edge 77 of fixture 70 and abutment 120 at intermediate portion 50C of stay-on-tab 50 to form in outer extremity 50B of stay-on-tab 50 a finger-engaging portion 50D that is upturned upwardly into notch 76 relative to inner extremity 50A of stay-on-tab 50 and upper surface 44 of lid 44. And so by moving abutment 120 from its open position as shown in FIG. 9 to its closed position as shown in FIG. 10, stay-on-tab 50 is bent between abutment 120 and corner or edge 77 to form upturned finger-engaging portion 50D in outer extremity 50B of stay-on-tab 50, which extends upwardly into notch 76 formed in lower end 72 of fixture 70.

Figure 11:
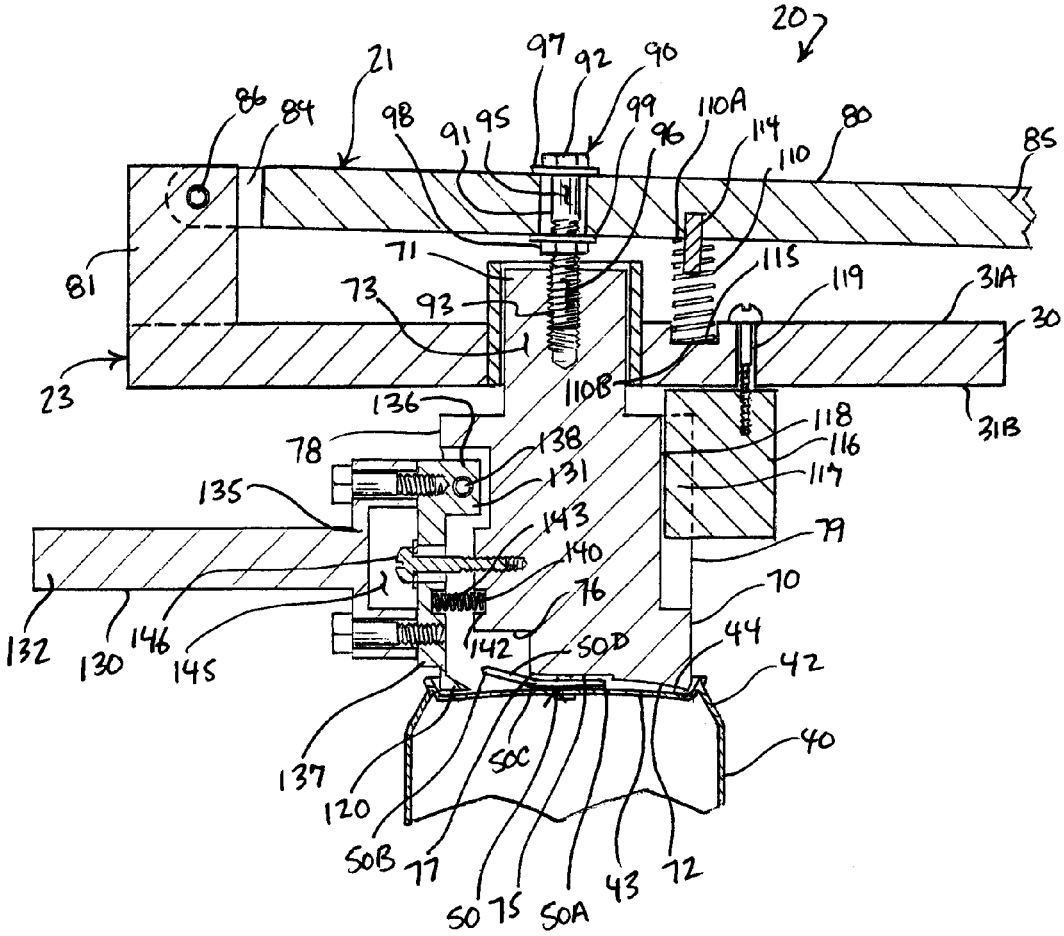
Figure 12:
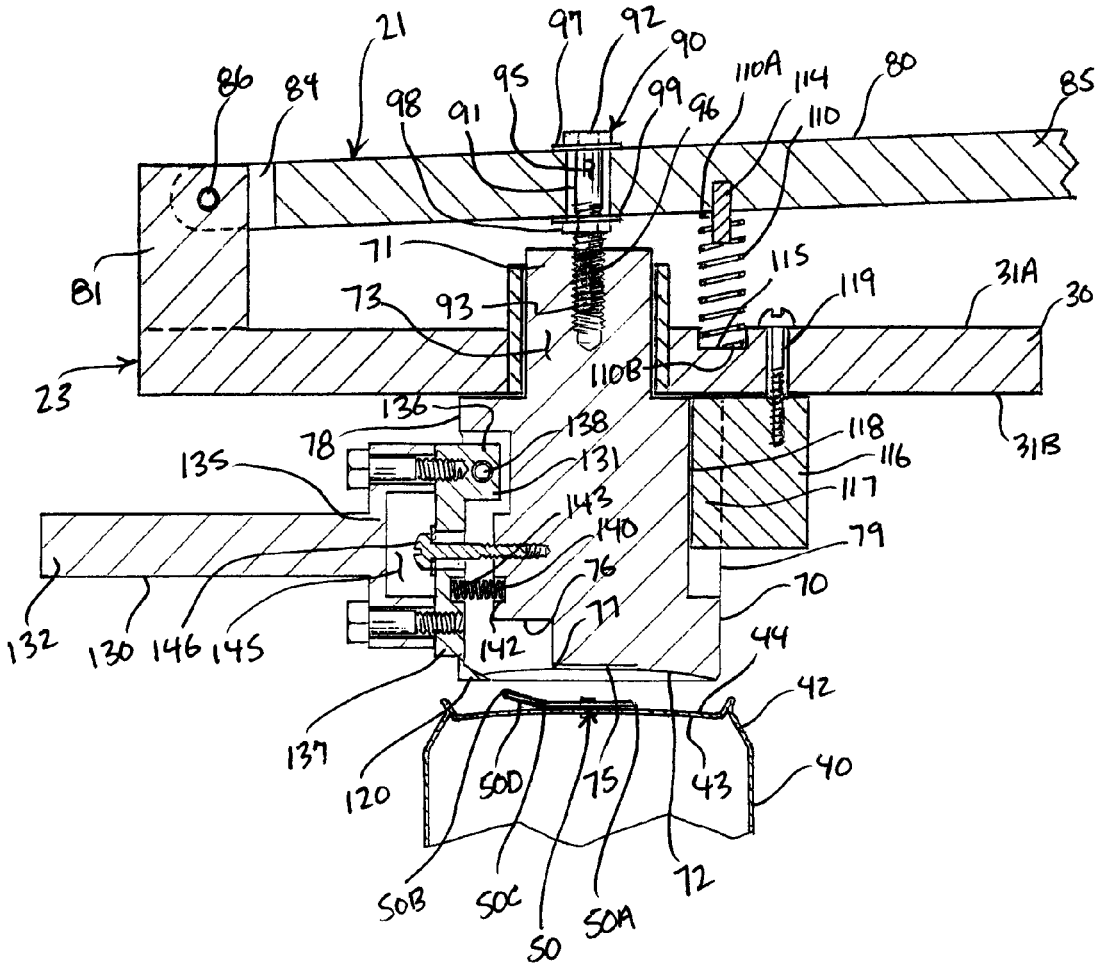

Having so formed finger-engaging portion 50D, abutment 120 is moved from its closed position in FIG. 10 back to its open position as shown in FIG. 11 through the pivoting of lever 130 from the lowered position of handled outer end 132 to the raised position of handled outer end 132 away from notch 76 and outer extremity 50B of stay-on-tab 50. Bending assembly 21 is then retracted away from container 40 by moving fixture 70 from its lowered position as shown in FIG. 11 to its raised position as shown in FIG. 12 through the pivoting of lever 80 from the lowered position of handled outer end 85 to the raised position of handled outer end 85 away from upper surface 31A of top support 30. At this point, bending assembly 21 is back in its starting position in preparation for repeating this bending procedure with the next container 40. To apply the next container 40 to bending apparatus 21, turntable 60 shown in FIG. 1 need only be rotated to bring the next container 40 in registration with bending assembly 21, which is again employed in the manner described above to form a finger-engaging portion in the stay-on-tab of that container 40. This process of forming finger-engaging portions in the stay-on-tabs is repeated for each container 40 held by conveyance 22 until all containers 40 have been so processed, after which the processed containers 40 may be removed and replaced with replacement containers to be processed with apparatus 20.

Figure 13:
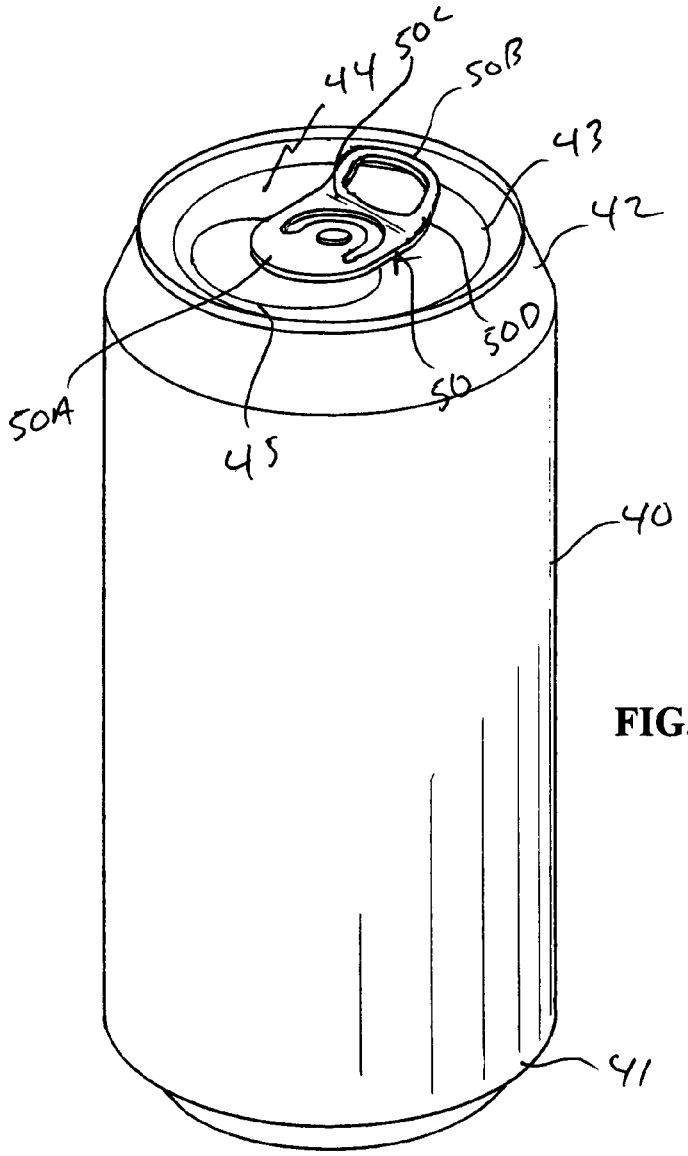
FIG. 13 is a perspective view of container including a stay-on-tab having a finger-engaging portion formed by the sequence of operation of the apparatus as illustrated in FIGS. 8-12.
Figure 14:
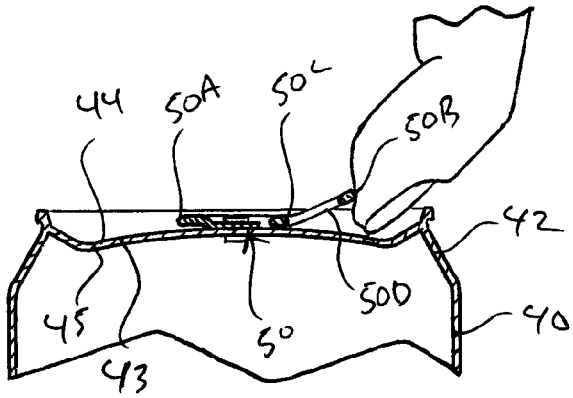
FIG. 14 is a fragmented, vertical section view of the container of FIG. 11 illustrating a finger applied to the finger-engaging portion of the stay-on-tab.

FIG. 13 is a perspective view of container 40 shown as it would appear with stay-on-tab 50 having a finger-engaging portion 50D formed through the operation of apparatus 20 as described above. Having formed finger-engaging portion 50D in stay-on-tab 50 of container 40 as shown in FIG. 13, a finger may be easily applied between upper surface 44 of lid 43 of container 40 and finger-engaging portion 50D as shown in FIG. 14 to allow a user to easily access and use stay-on-tab 50 to open lid 43 of container 40.

Turntable 60 is as preferred conveyance, and provides a convenient way to quickly and easily process a plurality of containers 40. Turntable 60 may be easily rotated for sequentially applying a plurality of containers to bending assembly 21. Rotation of turntable 60 is carried out manually, but may also be carried out with the aid of a machine or rotating device incorporated with turntable 60.

Figure 6:
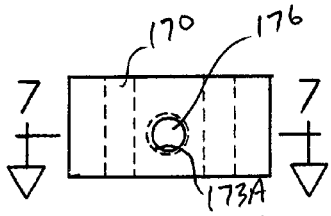
FIG. 6 is a front elevation view of the registration device of FIG. 5.
Figure 5:
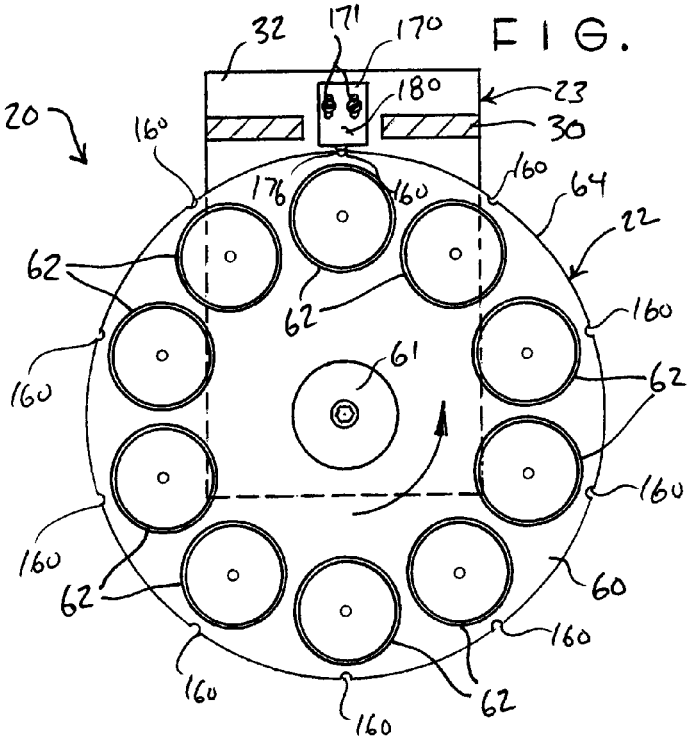
FIG. 5 is a fragmented, partially schematic top plan view of the apparatus of FIG. 1 illustrating a conveyance and a registration device.

Apparatus 20 is fashioned with a registration assembly to register receptacles 62 relative to bending assembly 21 to ensure containers 40 held by receptacles are properly registered with bending assembly 21 as turntable 60 is used to sequentially apply containers 40 to bending assembly 21 for processing. This registration assembly consists of notches 160 formed in perimeter edge of turntable 60 and a corresponding detent. Notches 160 each relate to one of receptacles 62. The detent is carried by a block 170 as shown in FIGS. 5 and 6. Block 170 is secured to bottom support 32 as shown in FIG. 5. Block 170 is located at an opening 180 formed through support member 30 of chassis, and is secured to bottom support 32 with threaded fasteners 171.

Figure 7:
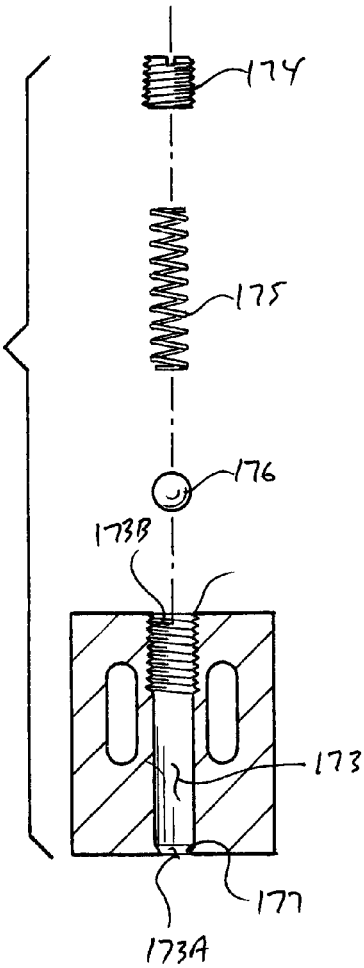
FIG. 7 is an exploded section view taken along line 7-7 of FIG. 6.

Looking to FIG. 7, block 170 is formed with a channel 173 having opposed inner and outer open ends 173A and 173B. Open end 173B is threaded and is closed with a threaded plug 174. A compression spring 175 and a ball 176 are disposed in channel 173. Ball 238 is located at open end 173A, and open end 173A is inwardly tapered forming a seat 177, which prevents ball 176 from falling outwardly through open end 173A, yet allows ball 176 to present outwardly relative to open end 173A. Spring 175 is captured between plug 174 and ball 176, and biases ball 176 against seat 177 such that ball 176 is biased outwardly relative to open end 173A. In this embodiment, spring 175 is a compression spring, although any suitable spring form capable of applying a bias against ball 176 can be used without departing from the invention.

Looking to FIG. 5, block 170 is positioned at opening 180 formed in support member 30 at bottom support 32 to direct ball 176 toward and against perimeter edge 64 of turntable 60. When ball 176 encounters a notch 160, ball 176, which constitutes a detent, will snap into the notch 160 securing turntable 60 in place registering the corresponding receptacle 62 and the container carried thereby with bending assembly 21, which may then be used to form a finger-engaging portion in the stay-on-tab of the container. Turntable 60 may then be rotated to dislodge ball 176 from the corresponding notch 161 until ball 176 encounters and snaps into the next notch 161 registering the next receptacle 62 and the container carried thereby with bending assembly 21. It is important that as each container is brought to bending assembly 21 for processing that the stay-on-tab registers with bending assembly 21 as previously described to allow bending assembly 21 to form the finger-engaging portion in the stay-on-tab in the operation of bending assembly 21. This may be done simply by rotating the containers as needed. The bias applied to ball 176 by spring 175 keeps ball 176 in the proper position allowing it to run along perimeter edge 64 of turntable 60, and yet provides ball 176 with compliance to allow ball 176 to snap into and out of the notches 161 formed in perimeter edge 64 of turntable 60 to sequentially register the receptacles 62 and the containers held thereby with bending assembly 21.

The present invention is described above with reference to a preferred embodiment. However, those skilled in the art will recognize that changes and modifications may be made in the described embodiment without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. An apparatus for forming a finger-engaging portion in a stay-on-tab attached as a lever to an upper surface of a lid of a container to depress a scored part of the lid, wherein the stay-on-tab has an inner extremity, an opposed outer extremity, an intermediate portion between the inner and outer extremities, the apparatus comprising:

a support;

a fixture mounted to the support for movement between a first position and a second position in opposition to the lid of the container, the fixture for bracing the stay-on-tab at the intermediate portion in the second position of the fixture;

a first lever having a first inner end and an opposed first handled outer end, the first lever mounted to the support at the first inner end for pivotal movement between a raised position of the first handled outer end away from the support and a lowered position of the first handled outer end toward the support;

the fixture coupled to the first handled lever between the inner end and the opposed handled outer end;

the fixture movable between the first and second positions in response pivotal movement of the first lever between the raised and lowered positions of the first handled end;

an abutment carried by a second lever having a second inner end and an opposed second handled outer end, the second lever mounted to the fixture at the second inner end for pivotal movement between a raised position of the second handled outer end toward the support and a lowered position of the second handled outer end away from the support;

the abutment movable between an open position and a closed position in opposition to the fixture and the outer extremity of the stay-on tab in the second position of the fixture in response pivotal movement of the second lever between the raised and lowered positions of the second handled end to bend the stay-on-tab between the fixture and the abutment at the intermediate portion of the stay-on-tab to form in the outer extremity of the stay-on-tab a finger-engaging portion that is upturned relative to the inner extremity of the stay-on-tab and upper surface of the lid.

2. The bending apparatus according to claim 1, further comprising a first bias applied to the first lever biasing the first lever toward the raised position of the first handled outer end.

3. The bending apparatus according to claim 2, wherein the first bias is applied by at least one first spring coupled between the first lever and the support biasing the first lever in the raised position of the first handled outer end.

4. The bending apparatus according to claim 3, further comprising a second bias applied to the second lever biasing the second lever toward the raised position of the second handled outer end.

5. The bending apparatus according to claim 4, wherein the second bias is applied by at least one second spring coupled between the second lever and the fixture biasing the second lever in the raised position of the second handled outer end.

6. The bending apparatus according to claim 5, wherein the at least one first spring comprises a first compression spring.

7. The bending apparatus according to claim 6, wherein the at least one second spring comprises a second compression spring.

* * * * *